US008166934B2

(12) United States Patent
Hertrich

(10) Patent No.: US 8,166,934 B2
(45) Date of Patent: May 1, 2012

(54) DEVICE FOR THE COMBINED LOCKING AND ROTATION ANGLE LIMITATION OF A CAMSHAFT ADJUSTER

(75) Inventor: Steffen Hertrich, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 361 days.

(21) Appl. No.: 12/524,505

(22) PCT Filed: Dec. 20, 2007

(86) PCT No.: PCT/EP2007/064300

§ 371 (c)(1),
(2), (4) Date: Jul. 24, 2009

(87) PCT Pub. No.: WO2008/089876

PCT Pub. Date: Jul. 31, 2008

(65) Prior Publication Data

US 2010/0101516 A1 Apr. 29, 2010

(30) Foreign Application Priority Data

Jan. 27, 2007 (DE) ..... 10 2007 004 184

(51) Int. Cl.
*F01L 1/34* (2006.01)

(52) U.S. Cl. ..... 123/90.17

(58) Field of Classification Search ..... 123/90.15, 123/90.17; 464/160
See application file for complete search history.

(56) References Cited

U.S. PATENT DOCUMENTS

| | | | | |
|---|---|---|---|---|
| 6,053,139 | A | 4/2000 | Eguchi et al. | |
| 6,192,844 | B1 * | 2/2001 | Scheidt et al. | 123/90.17 |
| 6,230,675 | B1 * | 5/2001 | Kobayashi et al. | 123/90.15 |
| 6,378,475 | B2 * | 4/2002 | Takenaka et al. | 123/90.17 |
| 6,634,329 | B2 * | 10/2003 | Kusano et al. | 123/90.17 |
| 6,779,499 | B2 * | 8/2004 | Takenaka et al. | 123/90.17 |
| 2001/0052330 | A1 * | 12/2001 | Takenaka et al. | 123/90.17 |
| 2005/0028772 | A1 * | 2/2005 | Komaki | 123/90.17 |
| 2008/0236528 | A1 * | 10/2008 | Hertrich et al. | 123/90.17 |

FOREIGN PATENT DOCUMENTS

| | | |
|---|---|---|
| DE | 198 60 418 A | 6/2000 |
| EP | 1 087 107 A | 3/2001 |
| FR | 20814 497 X | 3/2002 |
| WO | 2005/049976 A | 6/2005 |

* cited by examiner

*Primary Examiner* — Thomas Denion
*Assistant Examiner* — Daniel Bernstein
(74) *Attorney, Agent, or Firm* — Lucas & Mercanti, LLP; Klaus P. Stoffel

(57) ABSTRACT

A locking and rotation angle device for locking and setting maximum rotational adjustability of a drive part fixed to the crankshaft and a driven part fixed to the camshaft of a camshaft adjuster. The driven part is pivotably adjusted to the drive part, which has a locking bar received in the drive or driven part, a locking bar member formed in the respectively other part, and a rotation angle limiting member formed in the correspondingly other part. Limiting wall sections serve as stops for the locking bar for adjusting a maximum rotational adjustability. The locking bar member, rotation angle limiting member, and locking bar are disposed such that the locking bar is displaced via the displacement mechanism into a locking position, engaging into the locking bar member, and into an unlocking position, in which it is released by the locking bar member and engages in the rotation angle limiting member.

13 Claims, 4 Drawing Sheets

DEVICE FOR THE COMBINED LOCKING AND ROTATION ANGLE LIMITATION OF A CAMSHAFT ADJUSTER

This application is a 371 of PCT/EP2007/064300 filed Dec. 20, 2007, which in turn claims the priority of DE 10 2007 004 184.7 filed Jan. 27, 2007, the priority of both applications is hereby claimed and both applications are incorporated by reference herein.

FIELD OF THE INVENTION

The invention lies in the technical field of internal combustion engines and relates to a combined locking and rotational angle limiting device of a camshaft adjuster for an internal combustion engine.

PRIOR ART

In internal combustion engines, gas exchange valves are actuated by the cams of a camshaft which is set in rotation by the crankshaft. For this purpose, the cams conventionally roll on cam followers such as rocker arms, oscillating levers or cup tappets which act counter to the spring force of a valve spring which holds the gas exchange valve in a closed position. The control times of the gas exchange valves can be defined in a targeted fashion by means of the arrangement and shape of the cams.

Against the background of thermodynamic processes, it has proven to be advantageous when, during the operation of the internal combustion engine, the control times of the gas exchange valves are manipulated as a function of the present operating state, such as rotational speed or load. It is possible in this way, in particular, to positively influence the exhaust-gas behavior and to reduce fuel consumption. Furthermore, the efficiency of the internal combustion engine, the maximum torque and the maximum power can be increased. The opening and closing times of the gas exchange valves within a working cycle of the internal combustion engine are predefined by the relative rotational position (phase position) between the camshaft and crankshaft. An adjustment of the control times of the gas exchange valves within the working cycle may accordingly be obtained by means of a relative change in the rotational position between the crankshaft and camshaft.

The use of devices for changing and fixing the relative rotational position between the camshaft and, crankshaft, referred to below as "camshaft adjusters", is well known. A torque can be transmitted from the crankshaft to the camshaft by means of camshaft adjusters. Furthermore, it is possible by means of camshaft adjusters for the relative rotational position between the crankshaft and camshaft to be held, and adjusted within a certain angle range, during the operation of the internal combustion engine in order to thereby change the control times of the gas exchange valves.

A camshaft adjuster conventionally comprises a drive input part, which is rotationally fixedly connected by means of a drive input wheel to the crankshaft, and a drive output part which is fixed with respect to the camshaft, and also an actuating drive which is positioned between the drive input and drive output parts and which transmits the torque from the drive input part to the drive output part and permits fixing and adjustment of the relative rotational position between the drive input and drive output parts. The actuating drive may be electrically, hydraulically or pneumatically operated.

Hydraulically operated camshaft adjusters are typically designed as axial piston adjusters or rotary piston adjusters, which are explained in more detail below.

In an axial piston adjuster, the drive input part is geared by means of a helical toothing with a piston which itself is geared by means of a helical toothing with the drive output part. A pressure space is formed between the drive input and drive output parts, which pressure space is divided into two pressure chambers by the piston. If one of the two pressure chambers is acted on with pressure medium while the other is connected to a pressure medium outlet, the piston is moved in the axial direction, such that a change in the relative rotational position between the drive input and drive output parts is effected via the helical toothings.

In a rotary piston adjuster, the drive input part, which is formed, for example, in the manner of an outer rotor, and the drive output part, which is formed, for example, in the manner of an inner rotor, are arranged concentrically and so as to be rotationally adjustable with respect to one another. The outer rotor may be composed of a plurality of components which are rotationally fixedly connected to one another, such as a housing with a drive input wheel and with a stator which is rotatably mounted on the inner rotor (referred to below as a rotor).

In a rotary piston adjuster, pressure spaces are formed in the radial interspace between the stator and the rotor, for example, by virtue of a plurality of cavities which are spaced apart in the circumferential direction being formed in the stator, which cavities extend radially outward proceeding from the rotor and are delimited in a pressure-tight fashion in the axial direction by side walls. A sealing element, referred to below as a vane, which is connected to the rotor extends radially outward into each of said pressure spaces, as a result of which each pressure chamber is divided into two substantially pressure-tight pressure chambers. A pressure medium flow from the one pressure chamber into the other pressure chamber is at least substantially prevented by the vanes.

Pressure medium lines for the supply and/or discharge of pressure medium to and from the pressure chambers open out into each of the pressure chambers. By means of targeted pressurization of the pressure chambers, that is to say by generating a pressure difference across the pressure chamber pair of a respective pressure space, it is possible for the vanes to be pivoted within the pressure spaces, such that a rotation of the camshaft and, consequently, a change in the relative rotational position between the camshaft and crankshaft, is effected by means of the rotor which is rotationally fixedly connected to the camshaft. On the other hand, the rotational position can be maintained by means of a correspondingly equal pressurization of the two pressure chambers of a respective pressure space.

The hydraulic camshaft adjuster is controlled by means of a control unit which controls the inflow and outflow of pressure medium into and out of the individual pressure chambers on the basis of measured characteristic data of the internal combustion engine, such as for example rotational speed and load. The pressure medium flows are regulated for example by means of a control valve.

In order to prevent alternating torques or drag torques which occur at the camshaft from being transmitted to the stator in the event of an insufficient pressure medium supply, a locking device is provided for rotationally fixedly locking the stator and rotor in a so-called base position in which the stator and rotor assume a desired rotational position, in particular an optimum rotational position for the start or idle of an internal combustion engine.

A conventional locking device for locking the rotor and stator in a base position comprises, for example, a piston which is held in a recess of the rotor and which is forced out of the inner rotor in the axial direction by a spring and which, in order to provide locking in the base position, can engage into a slot which is formed by the stator, as a result of which a positively locking mechanical connection is created between the rotor and the stator. Depending on the application of the camshaft adjuster on an inlet or outlet camshaft, the base position is usually one of the maximum relative rotational positions (end rotational positions) of the rotor with respect to the stator, which positions are referred to as "early" or "late" positions of the rotor. Here, the late position corresponds to an end rotational position of the rotor in a rotational direction which is directed counter to the rotor rotational direction (in terms of the drive by the crankshaft), while the early position corresponds to an end rotational position of the rotor in a rotational direction which is the same as the rotor rotational direction.

The maximum possible rotational angle range is predefined by the early or late stops of the vanes within the pressure spaces or by a separate rotational angle limiting device, as is the case in camshaft adjusters produced from sheet-metal parts.

While a late position of the rotor is automatically assumed, in the event of an insufficient pressure medium supply, as a result of an inherent drag torque of the camshaft which is transmitted to the rotor, special precautions must be taken, such as the provision of a spring element which engages on the rotor, for the adjustment of the rotor into the early position or, for example, into a central position which is situated between the early and late positions.

A disadvantage of conventional camshaft adjusters is the fact that the assembly thereof is relatively expensive and time-consuming since, for an alignment of the locking device, it is necessary to take into consideration that rotational position of the rotor which corresponds to the desired base position, which rotational position itself is already afflicted with tolerances, for example as a result of a rotational angle limiting device, such that the locking device can only be set with a relatively large degree of locking play in industrial series production. As a result, this leads to a poorly defined rotational position of the rotor in the base position, and accordingly to poorly set control times of the gas exchange valves.

To realize a relatively small degree of locking play, it is necessary to pair further components. Very small degrees of locking play can be realized only by the selection of corresponding camshaft adjusters.

SUMMARY OF THE INVENTION

Object of the Invention

In contrast, it is the object of the present invention to provide a locking device of a camshaft adjuster for an internal combustion engine, by means of which locking device the above-stated disadvantage of a relatively large degree of locking play can be avoided. Furthermore, it should be possible to produce the locking device in a simple and cost-effective manner.

Achievement of the Object

Said object, and further objects, are achieved according to the proposal of the invention by means of a combined locking and rotational angle limiting device of a camshaft adjuster for an internal combustion engine having the features of the independent claim. Advantageous refinements of the invention are specified by the features of the subclaims.

The invention proposes a combined locking and rotational angle limiting device for rotationally fixed locking and setting a relative rotational adjustability of a drive input part, which is fixed with respect to a crankshaft or which can be drive-connected to a crankshaft, and a drive output part, which is rotatably adjustable relative to said drive input part and which is fixed with respect to a camshaft or which can be drive-connected to a camshaft, of a camshaft adjuster for an internal combustion engine. As is conventional, the camshaft adjuster serves as a device for transmitting a torque between the drive input and drive output parts and for adjusting and fixing the relative rotational position (phase position) between the crankshaft and camshaft. The drive input and drive output parts may for example be formed in the manner of an outer rotor, with a drive input wheel which is integrally formed thereon and which is drive-connected to the crankshaft, and an inner rotor which is arranged concentrically with respect to the outer rotor.

The combined locking and rotational angle limiting device according to the invention includes a locking element, referred to below as a "bar", which is held in the drive input or drive output part and which can be moved by a movement mechanism. For locking the bar, a bar slot is formed in the corresponding other part, by means of which bar slot the bar can be held in a positively locking fashion in the circumferential direction in order to thereby rotationally fixedly connect the drive input and drive output parts to one another.

The combined locking and rotational angle limiting device according to the invention further comprises a rotational angle limiting slot which is formed in the corresponding other part and by means of which the same bar can be held in the circumferential direction with a spacing to the boundary wall. Here, substantially radial boundary wall sections, which are spaced apart from one another in the circumferential direction, of the boundary wall of the rotational angle limiting slot serve as stops for the bar, which is held in the rotational angle limiting slot, in order to set a maximum rotational adjustability of the drive input and drive output parts in the event of a relative rotational adjustment of the drive input and drive output parts in the two rotational directions.

In the combined locking and rotational angle limiting device according to the invention, the bar slot, the rotational angle limiting slot and the bar are arranged in such a way that the bar can be moved by the movement mechanism into a locked position, in which said bar engages into the bar slot and can be guided by the bar slot; and into an unlocked position, in which said bar is released by the bar slot, engages only into the rotational angle limiting slot and can be guided by the rotational angle limiting slot.

By means of the combined locking and rotational angle limiting device according to the invention, it is therefore possible to obtain locking of the drive input and drive output parts with a very small degree of locking play in relation to conventional locking devices, since it is merely necessary to adjust the same bar within the bar slot and the rotational angle limiting slot. In contrast to conventional camshaft adjusters with a separate rotational angle limiting device, it is advantageously not necessary to take into consideration any tolerances relating to the separate rotational angle limiting device.

In one advantageous refinement of the combined locking and rotational angle limiting device according to the invention, the bar slot is arranged within an (imaginary) extension, in the movement direction of the bar of the (boundary wall of the) rotational angle limiting slot. The bar slot and the rotational angle limiting slot are particularly advantageously arranged here so as to be axially offset with respect to one another, such that the bar slot is situated within an axial elongation of the rotational angle limiting slot.

In the above-specified refinement of the locking and rotational angle limiting device according to the invention, it may be advantageous when a substantially radial boundary wall section, which runs behind in the rotational direction of the drive output part, of the bar slot, is arranged closer in the circumferential direction to an in particular axial extension of a substantially radial boundary wall section, which runs behind in the rotational direction of the drive output part, of the rotational angle limiting slot, than to a boundary wall section, which runs ahead in the rotational direction of the drive output part, of the rotational angle limiting slot. It is particularly advantageous for a substantially radial boundary wall section, which runs behind in the rotational direction of the drive output part, of the bar slot, to be arranged in axial alignment with a substantially radial boundary wall section, which runs behind in the rotational direction of the drive output part, of the rotational angle limiting slot. This corresponds to locking in the early position of the drive output part.

In the above-specified refinement of the locking and rotational angle limiting device according to the invention, it may also be advantageous when a substantially radial boundary wall section, which runs ahead in the rotational direction of the drive output part, of the bar slot is arranged closer in the circumferential direction to an in particular axial extension of a substantially radial boundary wall section, which runs ahead in the rotational direction of the drive output part, of the rotational angle limiting slot, than to a boundary wall section, which runs behind in the rotational direction of the drive output part, of the rotational angle limiting slot. It is particularly advantageous for a substantially radial boundary wall section, which runs ahead in the rotational direction of the drive output part, of the bar slot, to be arranged in axial alignment with a substantially radial boundary wall section, which runs ahead in the rotational direction of the drive output part, of the rotational angle limiting slot. This corresponds to locking in the late position of the drive output part.

In the above-specified refinement of the locking and rotational angle limiting device according to the invention, it may also be advantageous if the bar slot is arranged substantially centrally between in particular axial extensions of a substantially radial boundary wall section, which runs behind in the rotational direction of the drive output part, and a substantially radial boundary wall section, which runs ahead in the rotational direction of the drive output part, of the rotational angle limiting slot. This corresponds to locking in the central position of the drive output part.

In a further particularly advantageous refinement of the combined locking and rotational angle limiting device according to the invention, the bar slot and the rotational angle limiting slot are formed in the manner of an in particular axially stepped slot, referred to below as a "stepped slot".

Especially in the above-specified case, it is particularly advantageous with regard to the obtainable (small) degree of locking play, when the bar slot and the rotational limiting slot are formed integrally.

In a further particularly advantageous refinement of the combined locking and rotational angle limiting device according to the invention, which may in particular, but not exclusively, be realized in connection with a stepped slot, the bar is guided by the rotational angle limiting slot with the interposition of a sliding member, such that instead of the bar, the sliding member comes into contact against the substantially radial boundary wall sections, which are spaced apart from one another in the circumferential direction, of the boundary walls of the rotational angle limiting slot. For this purpose, the bar is held in a movable fashion in the sliding member such that said bar can be moved into its locked position and into its unlocked position. The sliding member engages into the rotational angle limiting slot and is held in the rotational angle limiting slot, or in a receptacle, which is formed on the rotational angle limiting slot, in such a way that said sliding member, driven by the bar, can come into contact against the substantially radial boundary wall sections, which serve as stops, of the boundary wall of the rotational angle limiting slot. With the interposition of the sliding member which abuts against the substantially radial boundary walls of the rotational angle limiting slot, it is possible to set a maximum rotational adjustability (relative end rotational positions) of the drive input and drive output parts during a rotational adjustment of the drive input and drive output parts in both rotational directions.

The provision of a sliding member has the particular advantage that clamping of the bar in the early or late position as a result of a friction torque which is generated by frictional engagement between the bar and the substantially radial boundary wall of the rotational angle limiting slot, can be avoided, and the bar can therefore be moved into its locked position in a simple and reliable manner by being moved within the sliding member which bears against the substantially radial boundary wall section of the rotational angle limiting slot.

The bar slot and the rotational angle limiting slot are particularly advantageously formed in the drive input part, with it being possible in particular for said bar slot and rotational angle limiting slot to be formed in a sealing element, such as a sealing plate, which is arranged between a housing component and the drive output part. In this case, the bar slot and the rotational angle limiting slot may, for example, be formed in the manner of a radial recess of a central bore of the sealing element, which recess serves for the assembly of a central screw for fastening the drive output part and camshaft.

The invention also encompasses a camshaft adjuster which is provided with a combined locking and rotational angle limiting device as described above.

The invention also encompasses an internal combustion engine which is fitted with a camshaft adjuster of said type, and a motor vehicle having a camshaft adjuster of said type.

BRIEF DESCRIPTION OF THE DRAWINGS

The invention will now be explained in more detail on the basis of exemplary embodiments, with reference being made to the appended drawings. Identical elements or functionally identical elements are denoted by the same reference numerals in the drawings, in which.

DETAILED DESCRIPTION OF THE DRAWINGS

Figure 1:
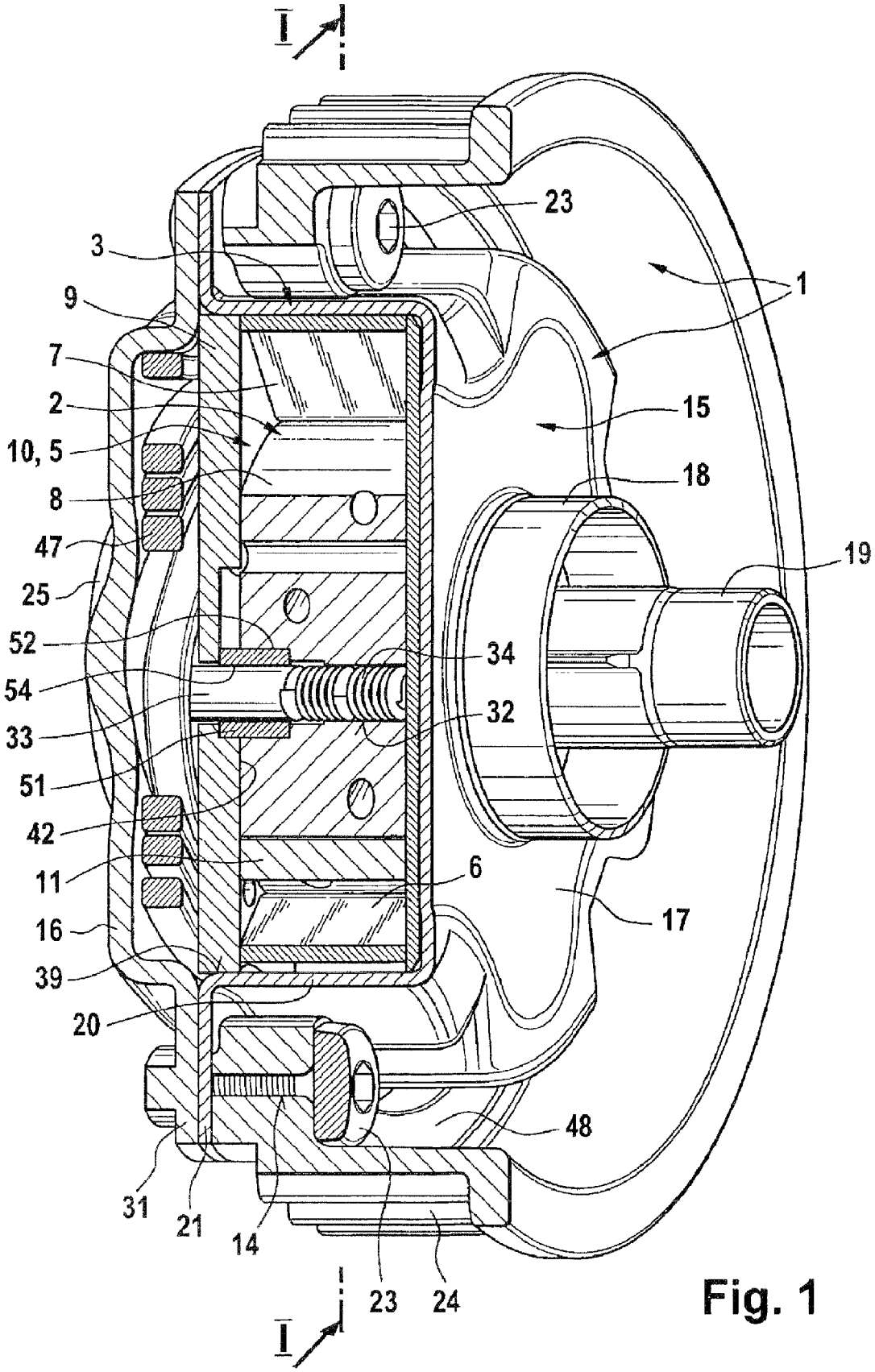
FIG. 1 shows a perspective, partially sectioned view through a camshaft adjuster with a combined locking/rotational angle limiting device according to the invention.
Figure 2:
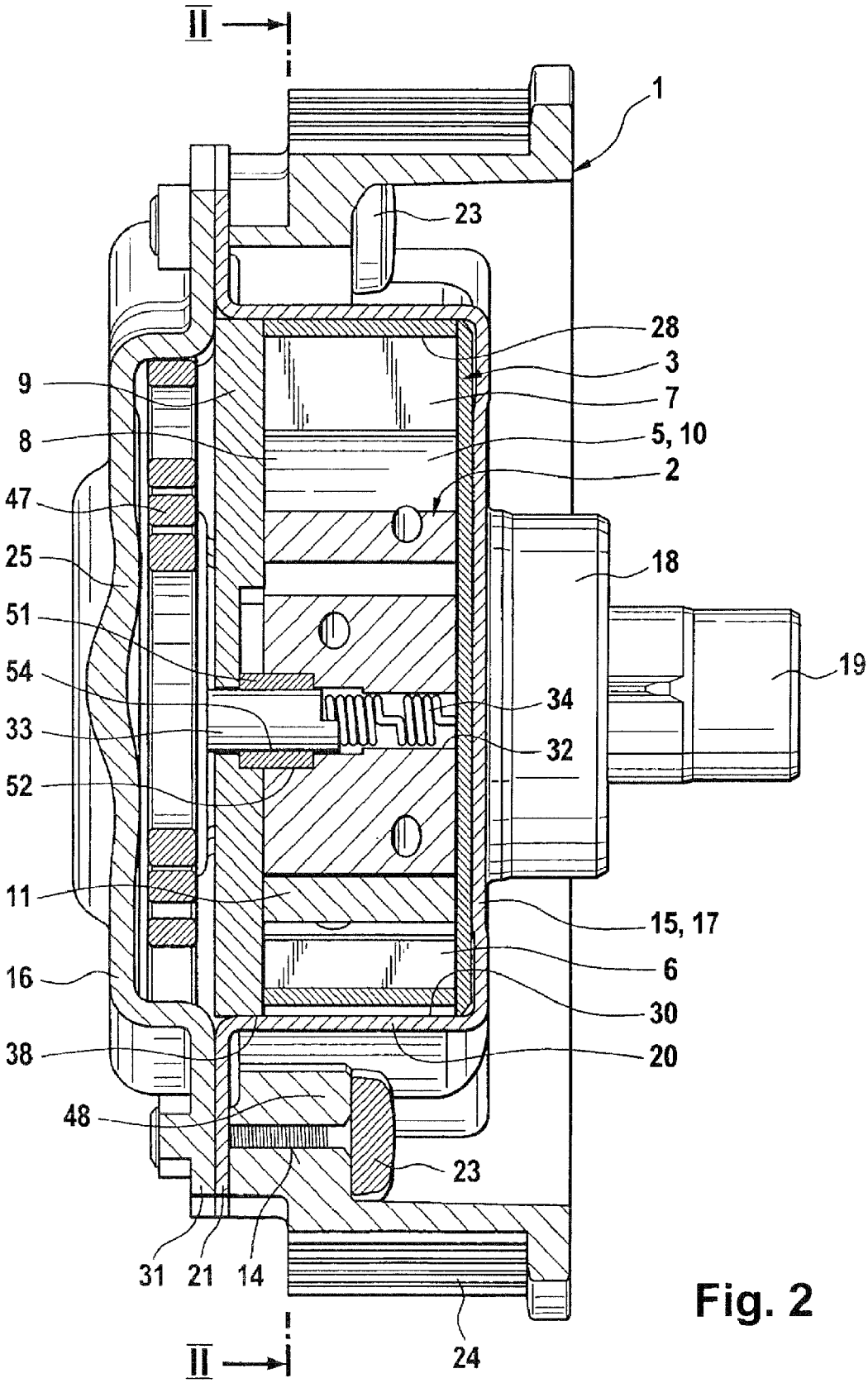
FIG. 2 shows an axial section as per line I-I in FIG. 1.
Figure 3:
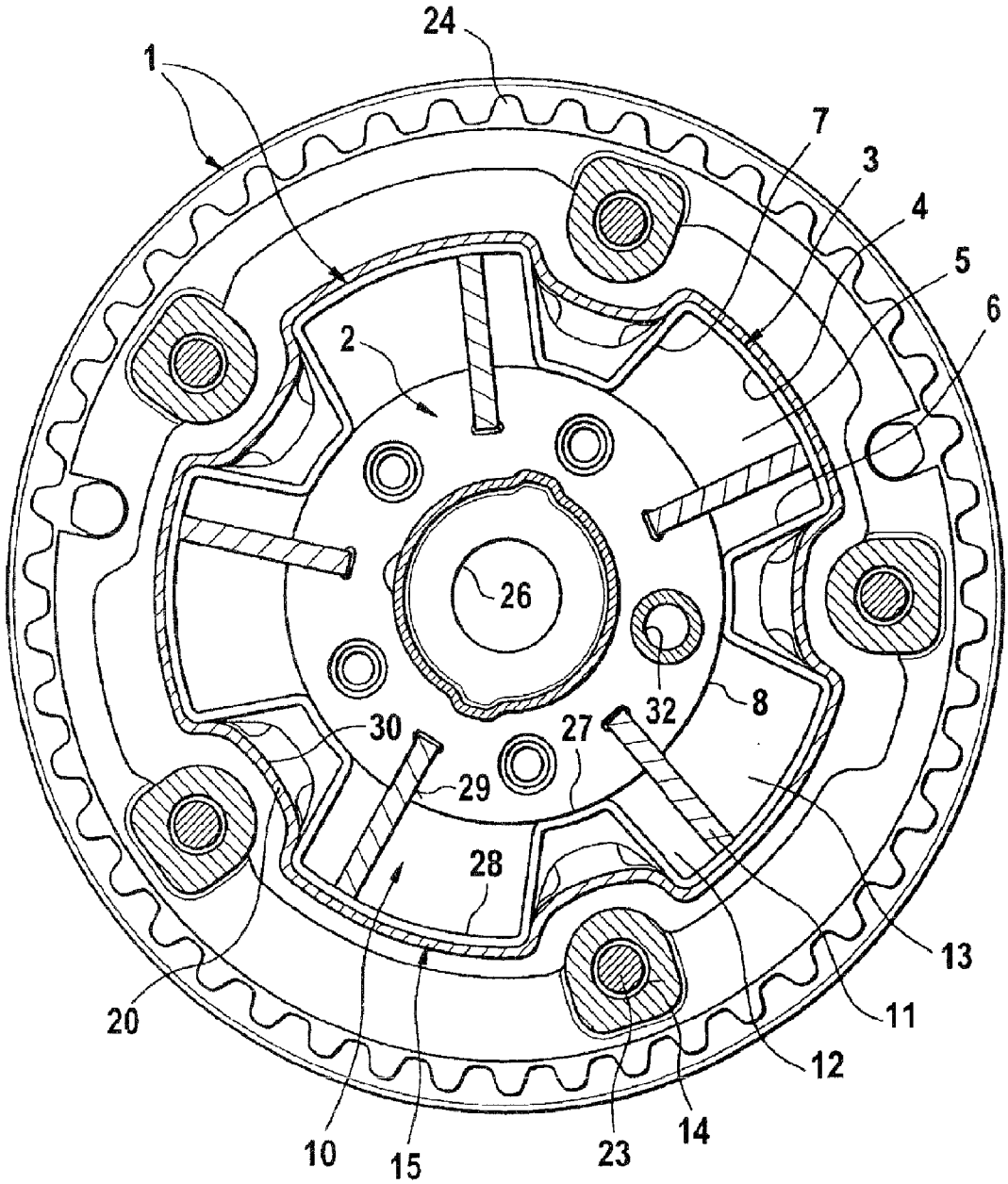
FIG. 3 shows a section perpendicular to the axial as per line II-II in FIG. 2.

The Figures illustrate a combined locking and rotational angle limiting device of a vane-type camshaft adjuster for the variable adjustment of the control times of the gas exchange valves of an internal combustion engine.

The vane-type camshaft adjuster comprises, as a drive input part, an outer rotor 1, which is drive-connected to a crankshaft by means of a drive input wheel 24, and as a drive output part, an inner rotor 2, referred to below as a rotor, which is arranged concentrically within the outer rotor 1 and which is rotationally fixedly connected to a camshaft 19.

The outer rotor 1 is itself constructed from a plurality of components which are rotationally fixedly connected to one another. The outer rotor 1 thus comprises a stator 3 which is formed, for example, as a sheet-metal part and whose inner lateral surface 4 is provided with a plurality of radial recesses 5 which are delimited in each case by radial side walls 6, 7. The inner lateral surface 4 of the stator 3 can accordingly be divided into inner circumferential walls 27 which extend in the circumferential direction and outer circumferential walls 28 which extend in the circumferential direction and radial side walls 6, 7 which connect the inner and outer circumferential walls to one another in each case. The stator 3, by means of its inner circumferential walls 27 which bear against an outer lateral surface 8 of the rotor 2, is rotatably mounted on the rotor 2. The stator 3 may, for example, be produced from sheet steel by means of a non-cutting shaping process, such as a deep-drawing process.

The recesses 5 form, together with an outer lateral surface 8 of the rotor 2 and two axial sealing surfaces which are explained in more detail further below, pressure spaces 10 which are arranged so as to be distributed in the circumferential direction.

A vane 11 projects radially outward into each pressure space 10 proceeding from the rotor 2, as a result of which the pressure spaces 10 are divided into two oppositely acting pressure chambers 12, 13, each one of which runs ahead in the rotational direction of the rotor 2 and the other of which correspondingly runs behind. In the example of a vane-type camshaft adjuster which is shown, the vanes 11 are held in each case in axial grooves 29 which are formed in the outer lateral surface 8 of the rotor 2. A spring element which loads the vane 11 in the radially outward direction is arranged on the groove base of each axial groove 29, which has the effect that the vanes 11 bear sealingly against the outer circumferential wall 28 of the stator 3. It would likewise be possible for the vanes 11 to be formed in one piece with the rotor 2 in the form of projections.

The outer rotor 1 also comprises a housing which encapsulates the stator 3 and the rotor 2 in a pressure-tight fashion and which is composed of a pot-shaped first housing part 15 and a disk-shaped second housing part 16 which is connected to said first housing part 15. The two housing parts 15, 16 may, for example, be produced from sheet steel by means of a non-cutting shaping process such as a deep-drawing process.

The first housing part 15 is provided, on a side facing toward the camshaft 19, with a base surface 17 in which is formed an upturned collar 18. The stator 3 is held in a centered fashion within the first housing part 15. The inner lateral surface 30 of the first housing part 15 is provided with radial projections 20 which engage into the respective depressions between the side walls 6, 7 of the inner lateral surface 4 of the stator 3, as a result of which a connection which is positively locking in the circumferential direction is produced between the stator 3 and the first housing part 15. A radial first flange 21 with axial bores 22 is formed on that side of the first housing part 15 which faces away from the camshaft 19.

The second housing part 16, which is arranged coaxially with respect to the first housing part 15, forms a second flange 31 which is of complementary design to the first flange 21 of the first housing part 15. Additionally, the second flange 31 is provided with bores which are arranged in axial alignment with the axial bores 22 of the first flange 21. The two housing parts 15, 16 are connected to one another by connecting means, in this case screws 23, which engage through the aligned axial bores.

The drive input wheel 24 is rotationally fixedly connected to the two housing parts 15, 16 by means of the screws 23, which additionally engage through bores 14 which are formed on a radially inwardly extending collar 48 of the drive input wheel 24.

Also provided in the second housing part 16 is a central bore 26 which makes it possible to fasten the rotor 2 to the camshaft 19 by means of a central screw. The bore 26 is closed off to the outside by means of a cover 25.

The abovementioned axial sealing surfaces for forming the pressure chambers 10 which are arranged so as to be distributed in the circumferential direction are formed by a sealing plate 9 which is arranged on the side facing away from the camshaft 19, and on the side facing toward the camshaft 19, by the base surface 17 of the first housing part 15, which sealing plate 9 and base surface 17 close off the pressure spaces or pressure chambers in a pressure-tight fashion in the axial direction.

The sealing plate 9 is rotationally fixedly connected to the first housing part 15. For the rotationally fixed connection to the stator 3, a radial outer lateral surface 38 of the sealing plate 9 is formed with indentations 39 into which the projections 20 formed by the inner lateral surface 30 of the first housing part 15 engage. The sealing plate 9 also serves to compensate any tolerances between the two housing parts 15, 16. Alternatively, the sealing of the pressure spaces or pressure chambers to the outside could be provided by means of the second housing part 16.

Pressure medium lines open out into the pressure chambers 12, 13, through which pressure medium lines pressure medium can be supplied to or discharged from the pressure chambers. By means of targeted pressurization with pressure medium, it is possible to build up a pressure gradient between the pressure chamber pair of each pressure space, which pressure gradient generates a pivoting movement of the vanes 11 and therefore a change in the relative rotational position of the rotor 2 with respect to the stator 3. In the case of an equal hydraulic pressure between a pressure chamber pair of each pressure space, the relative rotational position between the rotor 2 and stator 3 is maintained.

In order to prevent a transmission of alternating and drag torques of the camshaft 19 to the stator 3 in the event of an insufficient pressure medium supply, a locking device for locking the rotor 2 and stator 3 in a desired rotational position is provided. Said locking device comprises a piston 33 which is held in a recess 32 of the rotor 2 and which is forced in the direction of the sealing plate 9 by means of a spring element 34. In a selectable relative rotational position of the rotor 2 with respect to the stator 3, the piston 33 can engage into a cutout or slot which is formed by the sealing plate 9, as a result of which a positively locking connection is produced between the rotor 2 and the sealing plate 9 which is rotationally fixedly connected to the stator 3.

In order to prevent an abutment of the vanes 11 against the side walls 6, 7 of the pressure spaces 10 in the event of an insufficient pressure medium supply, a rotational angle limiting device is also provided for setting relative end rotational positions of the rotor 2 with respect to the stator 3 in both rotational directions.

To provide both locking of the rotor 2 and stator 3 and also setting of the relative end rotational positions of the rotor 2 with respect to the stator 3 using the same piston 33, the sealing plate 9 is provided with a slot 37, which is stepped in the axial direction, for the piston 33. The stepped slot 37 is formed as a radial recess of the radial boundary wall 53 of a central bore 36 of the sealing plate 9. The central bore 36 permits a fastening of the rotor 2 to the camshaft 19 by means of a central screw.

The stepped slot 37 is composed of two slots which are offset with respect to one another in the axial direction: a first slot 35 ("bar slot") arranged with a larger axial spacing to the camshaft 19, which first slot 35 serves to hold the piston 33 in a positively locking fashion, and a second slot 40 ("rotational angle limiting slot") which is arranged with a smaller axial spacing to the camshaft 19 and which serves to set the maximum relative end rotational positions of the rotor 2 with respect to the stator 3 in both rotational directions of the rotor 2.

The bar slot 35 and the rotational angle limiting slot 40 are separated from one another in the axial direction by the step 41. While the bar slot 35 is formed in the manner of an aperture through the sealing plate 9, the rotational angle limiting slot 40 is formed merely as an axial depression of that sealing surface 42 of the sealing plate 9 which faces toward the camshaft 19.

The radial boundary wall sections 43, 44 of the bar slot 35 are situated within an (imaginary) axial extension of the radial boundary wall sections 45, 46 of the rotational angle limiting slot 40.

The bar slot 35 extends in the circumferential direction in such a way that its radial boundary wall sections 43, 44 bear in the circumferential direction against the outer surface of the piston 33 which engages into the bar slot 35, such that a positively locking connection is produced in the circumferential direction between the rotor 2 and the stator 3 by means of the piston 33 which simultaneously is held in the recess 32 of the rotor 2 and engages into the bar slot 35.

The two radial boundary wall sections 43, 44 of the bar slot 35 are connected to one another by means of a circular-segment-shaped boundary wall section 49 which extends substantially in the circumferential direction.

The cylindrical piston 33 is held in a movable fashion in the cavity 54 of a piston sleeve 51. The piston sleeve 51 which engages into the rotational angle limiting slot 40 is itself held, so as to be movable in the circumferential direction, in a cutout (not illustrated in any more detail) between the sealing plate 9 and rotor 2. The piston 33 engages, in the locked position, through the piston sleeve 51. In the unlocked position, the piston 33 engages into the piston sleeve 51. The piston sleeve 51 is driven in the circumferential direction by the piston 33, which engages into said piston sleeve in the unlocked position, in the event of a change in the relative rotational position of the rotor 2 with respect to the stator 3.

In contrast to the bar slot 35, the rotational angle limiting slot 40 extends in the circumferential direction in such a way that its radial boundary wall sections 45, 46 do not bear against the outer surface of the piston 33, which simultaneously is held in the recess 32 of the rotor 2 and engages (only) into the rotational angle limiting slot, but rather in fact form stops for the piston 33 or the interposed piston sleeve 51 in order to define respective maximum end rotational positions of the rotor 2 with respect to the stator 3. In the two relative end rotational positions, the outer lateral surface 52 of the piston sleeve 51 comes into contact against the radial boundary wall sections 45, 46 of the rotational angle limiting slot 40. In this respect, a maximum rotational angle for the rotational adjustment of the rotor 2 with respect to the stator 3 can be set by means of the circumferential spacing of the radial boundary wall sections 45, 46 of the rotational angle limiting slot 40. The radial boundary wall sections 45, 46 of the rotational angle limiting slot 40 are connected to one another by means of a boundary wall section 50 which extends substantially in the circumferential direction.

The provision of the piston sleeve 51 has the advantage that, in the event of locking in the end rotational position, no friction torque can occur between the outer lateral surface of the piston 33 and the radial boundary wall sections 45, 46 of the rotational angle limiting slot 40, such that the piston 33 can be reliably moved into the bar slot 35 without the risk of becoming jammed/wedged.

The piston 33 can be moved by a movement mechanism between a locked position, in which said piston 33 engages into the bar slot 35, and an unlocked position, in which said piston 33 engages, with the interposition of the piston sleeve 51, (only) into the rotational angle limiting slot 40.

In the example shown, the piston 33 is forced into the bar slot 35 by the spring element 34. Only in a selectable relative rotational position (base position) of the rotor 2 with respect to the stator 3 can the piston 33 engage into the bar slot 35.

In the base position, the bar slot 35 communicates with at least one pressure medium line for the supply and discharge of pressure medium to and from the bar slot 35, such that an axial end surface of the piston 33 can be acted on hydraulically and the piston 33 can be pushed out of the bar slot 35 counter to the spring force of the spring element 34.

Here, the movement mechanism is designed such that the piston 33 can be forced, under hydraulic loading, in the direction of its recess 32 in the rotor 2 only to such an extent that said piston always still engages into the rotational angle limiting slot 40 or into the bar sleeve 51 which engages into the rotational angle limiting slot 40, in order to realize, in interaction with the piston sleeve 51 which is driven by said piston 33, a rotational angle limitation between the rotor 2 and the stator 3.

Figure 4:
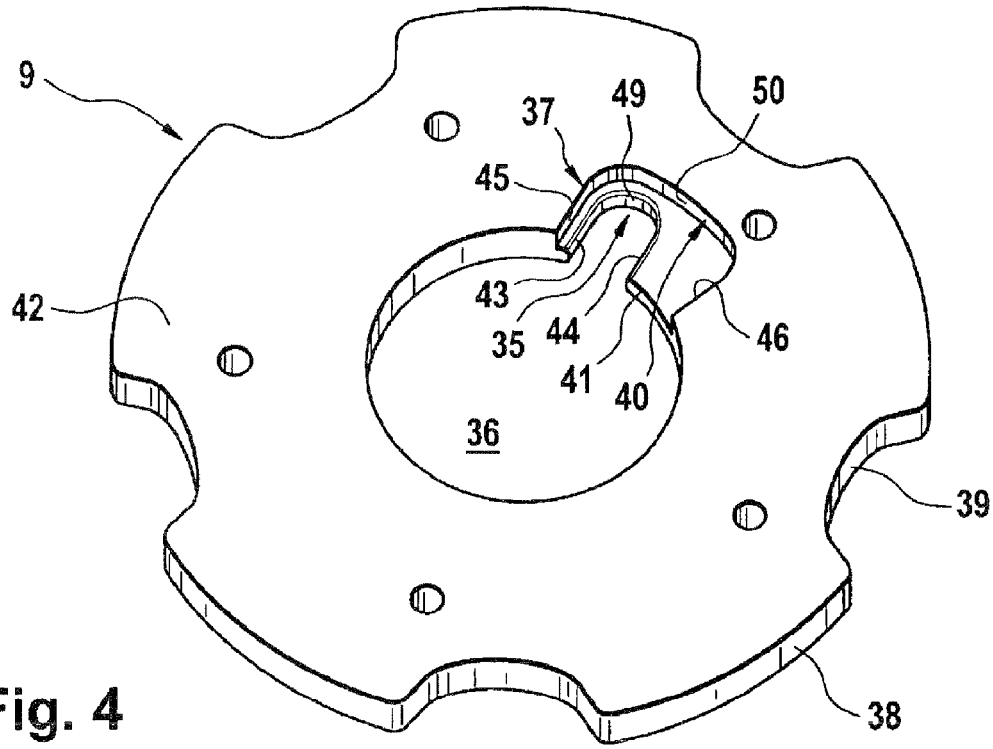
FIG. 4 shows a perspective view of a sealing plate with a stepped slot for locking in the early position.

In FIG. 4, the radial boundary wall sections 43, 45, which run ahead in the rotor rotational direction, of the bar slot 35 and of the rotational angle limiting slot 40 are arranged approximately in axial alignment with one another. This generates locking of the rotor 2 in the early position, in which, in the locked position, the vanes 41 are arranged closer to the side walls 6, which run ahead in the rotor rotational direction, than to the side walls 7, which correspondingly run behind, of the pressure spaces 10.

In order to adjust the rotor in the early position, a spring element 47 is provided which is connected both to the outer rotor 1 and also to the inner rotor 2. The forces which the spring element 47 exerts on the rotor 2 are directed such that, in the event of insufficient pressure medium charging of the pressure chambers, the rotor 2 and stator 3 are rotated into a relative rotational position (base position) in which the piston 33 can engage into the bar slot 35.

Instead of locking in the early position, locking in the late position would likewise be possible. For this purpose, it is merely necessary to design the stepped slot 37 such that the radial boundary wall sections 44, 46, which run behind in the rotor rotational direction, of the bar slot 35 and of the rotational angle limiting slot 40 are arranged approximately in axial alignment with one another.

Instead of locking in the early or late position, locking in the central position would likewise be possible.

Figure 5:
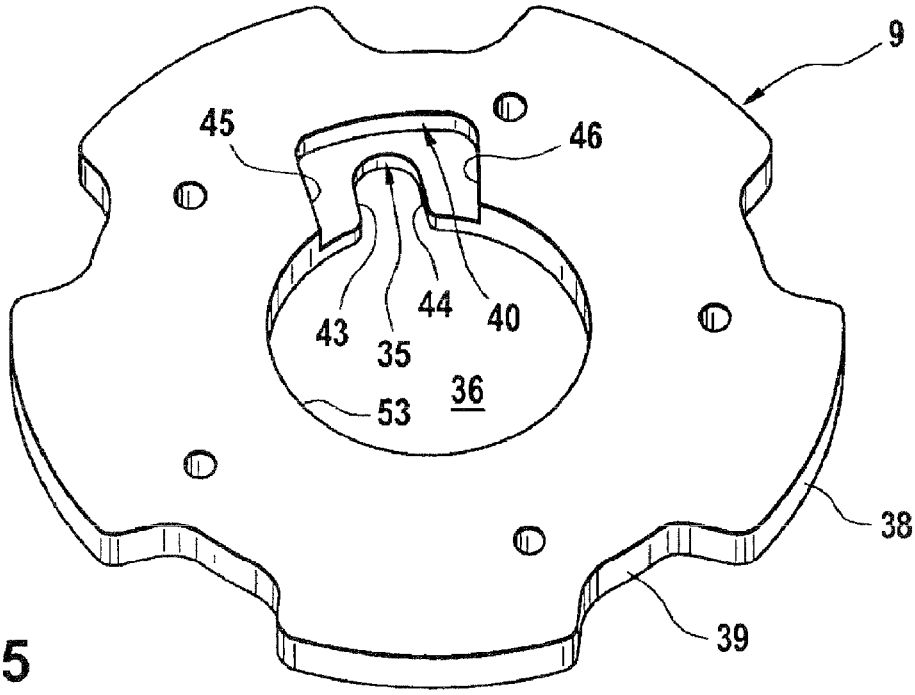
FIG. 5 shows a perspective view of a sealing plate with a stepped slot for locking in the central position.

FIG. 5 shows a sealing plate 9 of a further exemplary embodiment of the locking device according to the invention, with locking in the central position. In order to generate locking in the central position, it is merely necessary for the radial boundary wall sections 43, 44 of the bar slot 35 to be arranged approximately centrally in the circumferential direction between an (imaginary) axial extensions of the radial boundary wall sections 45, 46 of the rotational angle limiting slot 40.

The sealing plate 9 is advantageously produced from a hardenable steel, such that said sealing plate 9 can, after the shaping process, be subjected to a hardening process in order to ensure that the forces transmitted via the piston 33 can be absorbed in a functionally reliable manner.

Even though the bar slot 35 is formed in the manner of an aperture in FIGS. 4 and 5, it would likewise be possible for said bar slot 35 to be formed merely in the manner of an axial depression in the sealing surface 42 of the sealing plate 9.

Even though the stepped slot 37 is formed in the sealing plate 9 in FIGS. 4 and 5, it would likewise be possible for the stepped slot to be formed in the second housing part 16 or in some other component of the outer rotor 1.

Even though a movement mechanism is shown in which the spring-loaded piston 33 can be unlocked hydraulically, it is likewise possible to provide some other movement mechanism, such as for example a movement of the piston 33 by means of an electric actuating motor.

LIST OF REFERENCE SYMBOLS

1 Outer Rotor
2 Inner Rotor (Rotor)
3 Stator
4 Inner Lateral Surface
5 Recess
6 Side Wall
7 Side Wall
8 Outer Lateral Surface
9 Sealing Plate
10 Pressure Space
11 Vane
12 Pressure Chamber
13 Pressure Chamber
14 Bore
15 First Housing Part
16 Second Housing Part
17 Base Surface
18 Boss
19 Camshaft
20 Projection
21 First Flange
22 Bore
23 Screw
24 Drive Input Wheel
25 Cover
26 Bore
27 Inner Circumferential Wall
28 Outer Circumferential Wall
29 Axial Groove
30 Inner Lateral Surface
31 Second Flange
32 Recess
33 Piston
34 Spring Element
35 Bar Slot
36 Bore
37 Stepped Slot
38 Outer Lateral Surface
39 Indentation
40 Rotational Angle Limiting Slot
41 Step
42 Sealing Surface
43 Radial Boundary Wall Section
44 Radial Boundary Wall Section
45 Radial Boundary Wall Section
46 Radial Boundary Wall Section
47 Spring Element
48 Collar
49 Circumferential Boundary Wall Section
50 Circumferential Boundary Wall Section
51 Piston Sleeve
52 Outer Lateral Surface of the Piston Sleeve
53 Radial Boundary Wall
54 Cavity

The invention claimed is:

1. A combined locking and rotational angle limiting device for locking and setting a maximum rotational adjustability of a drive input part, which is fixed with respect to a crankshaft, and a drive output part, which is rotatably adjustable relative to said drive input part and which is fixed with respect to a camshaft, of a camshaft adjuster for an internal combustion engine, comprising:

a bar which is held in the drive output part and which is moved by a movement mechanism;

a sealing element, which is formed in the drive input part and is arranged between a housing component and the drive output part, having a central bore with a bar slot and a rotational angle limiting slot each forming a radial recess of the bore, the bar slot holds the bar in a positively locking fashion in a circumferential direction, and the rotational angle limiting slot holds the bar in the circumferential direction, the rotational angle limiting slot has radial boundary wall sections, which are spaced apart in the circumferential direction, serving as stops for the bar in order to set a maximum rotational adjustability of both the drive input and the drive output part, and the bar slot, the rotational angle limiting slot and the bar are arranged in such a way that the bar is moved by the movement mechanism into a locked position, in which locked position said bar is guided by the bar slot, and the bar is moved by the movement mechanism into an unlocked position, in which unlocked position said bar is guided by the rotational angle limiting slot, wherein the bar is guided by the rotational angle limiting slot with an interposition of a sliding member engaging into the rotational angle limiting slot, and the bar is held in the sliding member so as to be movable in a bar movement direction.

2. The combined locking and rotational angle limiting device of claim 1, wherein the bar slot is arranged within an axial extension, in the bar movement direction, of the rotational angle limiting slot.

3. The combined locking and rotational angle limiting device claim 2, wherein the bar slot and the rotational angle limiting slot are offset in an axial direction.

4. The combined locking and rotational angle limiting device of claim 3, wherein the bar slot is arranged substantially centrally between axial extension of a substantially radial boundary wall section, which extends behind in the rotational direction of the drive output part, and a substantially radial boundary wall section, which extends ahead in the rotational direction of the drive output part, of the rotational angle limiting slot.

5. The combined locking and rotational angle limiting device of claim 1, wherein the bar slot and the rotational angle limiting slot are formed in the manner of a stepped slot.

6. The combined locking and rotational angle limiting device of claim 5, wherein a substantially radial boundary wall section, which extends behind in a rotational direction of the drive output part, of the bar slot, is arranged closer in the circumferential direction to an axial extension of a substantially radial boundary wall section, which extends behind in the rotational direction of the drive output part, of the rotational angle limiting slot, than to an axial extension of a substantially radial boundary wall section, which extends ahead in the rotational direction of the drive output part, of the rotational angle limiting slot.

7. The combined locking and rotational angle limiting device of claim 6, wherein the substantially radial boundary wall section, which extends behind in the rotational direction of the drive output part, of the bar slot, is arranged in axial alignment with the substantially radial boundary wall section, which extends behind in the rotational direction of the drive output part, of the rotational angle limiting slot.

8. The combined locking and rotational angle limiting device of claim 5, wherein a substantially radial boundary wall section, which extends ahead in a rotational direction of the drive output part, of the bar slot, is arranged closer in the circumferential direction to an axial extension of a substantially radial boundary wall section, which extends ahead in the rotational direction of the drive output part, of the rotational angle limiting slot, than to an axial extension of a substantially radial boundary wall section, which extends behind in the rotational direction of the drive output part, of the rotational angle limiting slot.

9. The combined locking and rotational angle limiting device of claim 8, wherein the substantially radial boundary wall section, which extends ahead in the rotational direction of the drive output part, of the bar slot, is arranged in axial alignment with the substantially radial boundary wall section, which extends ahead in the rotational direction of the drive output part, of the rotational angle limiting slot.

10. The combined locking and rotational angle limiting device of claim 1, wherein the sliding member is a sleeve.

11. A camshaft adjuster having a combined locking and rotational angle limiting device as claimed in claim 1.

12. An internal combustion engine having a combined locking and rotational angle limiting device as claimed in claim 1.

13. A motor vehicle having an internal combustion engine of claim 12.

* * * * *